United States Patent [19]

Goncalves

[11] Patent Number: 5,018,894

[45] Date of Patent: May 28, 1991

[54] APPLICATOR DEVICE FOR A LIQUID COMPRISING A DOME MADE OF A POROUS MATERIAL

[75] Inventor: Antonin Goncalves, Montmorency, France

[73] Assignee: L'Oreal, Paris, France

[21] Appl. No.: 524,022

[22] Filed: May 16, 1990

[30] Foreign Application Priority Data

May 18, 1989 [FR] France ..... 89 06490

[51] Int. Cl.[5] ..... B05C 1/06

[52] U.S. Cl. ..... 401/202; 401/205

[58] Field of Search ..... 401/198, 206, 205, 207, 401/213, 202, 196

[56] References Cited

U.S. PATENT DOCUMENTS

| | | | |
|---|---|---|---|
| 3,281,887 | 11/1966 | Raffe | 401/205 |
| 3,340,561 | 9/1967 | Schwartzman | 401/206 X |
| 4,368,746 | 1/1983 | Spatz | 401/205 |
| 4,747,720 | 5/1988 | Bellehumeur et al. | 401/205 |
| 4,811,726 | 3/1989 | Goncalves | 401/213 |

FOREIGN PATENT DOCUMENTS

| | | |
|---|---|---|
| 167657 | 8/1984 | European Pat. Off. . |
| 1256558 | 12/1967 | Fed. Rep. of Germany . |
| 1420454 | 10/1964 | France . |
| 1461651 | 10/1965 | France . |
| 2478589 | 3/1980 | France . |
| 1571662 | 4/1977 | United Kingdom . |
| 2083743 | 8/1981 | United Kingdom . |
| 2084455 | 9/1981 | United Kingdom . |

*Primary Examiner*—Richard J. Johnson

*Attorney, Agent, or Firm*—Cushman, Darby & Cushman

[57] ABSTRACT

An applicator device (1) for a preferably cosmetic liquid, includes a dispensing head (5) comprising a dispensing dome (6) of a porous material, an obturator (7) fixed on the neck (3) of the bottle (2) and provided with at least one opening (22) capable of communicating the bottle (2) with the dome (6), and a cap (8) comprising means (24, 29) for supporting the dome (6). The cap (8) is mechanically joined to the obturator (7) and is manually actuable in translation between a closed position, wherein a closing element (26) of the cap (8) cooperates with a stopper element (20) of the obturator (7) to prevent any communication between the inside of the bottle (2) and the dome (6), and an open position in which that communication is obtained. The porous material of the dispensing dome (6) is rigid and the neck of the bottle comprises a flexible zone, constituted by, for example, a bellows (9).

15 Claims, 2 Drawing Sheets

APPLICATOR DEVICE FOR A LIQUID COMPRISING A DOME MADE OF A POROUS MATERIAL

FIELD OF THE INVENTION

The present invention concerns an applicator device for a liquid, of the kind comprising a bottle provided with a neck having fixed thereon a dispensing head carrying a dispensing dome, the dispensing head comprising on the one hand, an obturator fixed on the neck of the bottle and provided with at least one opening, and on the other hand, a cap comprising means for supporting the dome, the cap being mechanically joined to the obturator and being manually actuable for translation parallel to the longitudinal axis of the applicator device between a closed position, wherein a closing element of the cap cooperates with a stopper element of the obturator to prevent any communication between the inside of the bottle and the dome, and an open position allowing said communication.

The present invention concerns a device for applying any liquid to a surface. It is particularly useful for applying cosmetic liquids such as after shave lotions, sun products, perfumes, deodorants, or for the local application of pharmaceutical products, for example antiseptics, analgesics, fungicides or products for the treatment of acne.

DESCRIPTION OF THE PRIOR ART

An applicator device of this kind, intended in particular for a face or body lotion, is known in the FR-A-1461651.

In that device, the dome is constituted by a pad made of a foam material or similar, which is relatively fragile and liable to tear.

Applicator devices are known, in particular from EP-A-0167657, which comprise a bottle having a dispensing head provided with a convex dome of a porous plastic material through which the liquid is dispensed. Such rigid domes are formed from synthetic resins such as high or low density polyethylene, polypropylenes and polyvinyl fluorides which have been sintered, so as to obtain pores intercommunicating with each other in all directions. These porous plastic materials are produced over a wide porosity range, extending in general from 1 to 200 microns. The liquid is dispensed by capillarity through the dome.

Such a dome made of a plastic or rigid porous ceramic material is not liable to tear like a foam pad, but has other drawbacks being in particular less soft in application and lacking in elasticity.

Moreover, in the case of an embodiment in accordance with EP-A-0167657, the communication between the bottle and the dome of porous material is not closed, and to prevent leakages of liquid during storage due to evaporation or a faulty positioning of the applicator device, the rigid dome of plastic material must be caused to come into contact with an absorbent ring in the cap which closes the applicator device; bacteria tend to spread in this ring and thence to invade the dispensed liquid, which may cause skin irritations during subsequent applications of the liquid to be dispensed.

SUMMARY OF THE INVENTION

The present invention aims to provide an applicator device of the kind defined above which no longer has the drawbacks of a domed pad of foam material, whilst retaining its advantages, and which can be closed so that there is no leakage risk during storage.

Accordingly, the present invention provides an applicator device for a liquid, comprising: a bottle having a neck comprising at least one flexible zone and on which is fixed a dispensing head carrying a dispensing dome of rigid porous material; wherein the dispensing head comprises on the one hand, an obturator fixed on the neck of the bottle and provided with at least one opening and, on the other hand, a cap comprising means for supporting the dispensing dome; and wherein the cap is mechanically joined to the obturator and is manually actuable in translation parallel to the longitudinal axis of the applicator device between a closed position in which a closing element of the cap cooperates with a stopper element of the obturator to prevent any communication between the inside of the bottle and the dispensing dome, and an open position wherein said communication is obtained.

Advantageously, the dome is made of a rigid porous plastic or ceramic material.

Thus, although the dome is rigid, it can conform perfectly to the parts of the body, thanks to the flexibility of the neck.

Preferably, the flexible zone of the neck is constituted by a bellows.

The compression and dilation of the bellows during application produces, in addition to the softness of application, better dispensing of the product: during an upside down application, depending on the force applied by the user, the volume of the reservoir will be reduced, and more of the product will flow out. When the pressure ceases, the internal volume increases as a result of the dilation of the bellows; on the one hand this produces a renewed air intake and, on the other hand, any excess of the product on the skin can be sucked in if necessary.

In the storage position, the communication between the inside of the bottle and the dome is closed by the cooperation of the obturator and the cap. The dome of rigid porous material is, therefore, not permanently in contact with the liquid to be dispensed, and the cover cap intended to cover this dome therefore does not need to be provided with an absorbent ring.

The obturator may comprise a cylindrical fixing skirt with a circular base carrying a screw thread which cooperates with a corresponding screw thread on the neck, said fixing skirt being joined to a stopper element centred on the axis of the neck.

The obturator may comprise a cylindrical sealing skirt which, firstly is coaxial with the fixing skirt and annularly joined thereto, secondly is disposed inside the neck, and thirdly is annularly joined to a central duct coaxial with the fixing skirt and sealing skirt, the duct being open towards the inside of the bottle and closed at its other end by the stopper element, the opening or openings being arranged in the side wall of the duct.

The obturator may comprise a guidance skirt coaxial with the fixing skirt and carried by the annular connection between the sealing skirt and the side wall of the duct towards the dome, said guidance skirt cooperating, with slight friction, with an associated skirt carried by the element for closing the cap.

In the cap, the elements for supporting the dome are advantageously constituted by two coaxial cylindrical walls, an inner one and an outer one, interconnected at their edges situated on the side of the bottle, these two walls forming between them a space having a radial dimension such that the edge of the dome can be inserted therein, the wall closer to the axis of the bottle being near the fixing skirt of the obturator.

The inner cylindrical wall may have on its inner side a helical groove cooperating with an outwardly projecting stud on the fixing skirt of the obturator so as to render the cap movable for translation in relation to the obturator when it is caused to rotate in relation to the bottle, the stopper element being a flat disc which is capable of being accommodated in an opening in the central zone of the closing element.

Preferably, the inner cylindrical wall of the cap comprises at its end nearer the dome a closing element forming a top which forms with the outer cylindrical wall an angle equal to or slightly less than 90° so that, when the dispensing head is in the closed position, the closing element bears with the edge of its opening against the edge of the disc so as to form a leakproof seal closing the duct of the obturator, whereas when the dispensing head is in the open position, the closing element is disposed in the space comprised between the disc and the dome.

The inner cylindrical wall of the cap may be extended towards the bottle by a cylindrical support skirt having an external diameter close to that of the bottle at the base of the neck and a length such that, in the closed position of the dispensing head, the skirt bears on a shoulder situated at the base of the neck of the bottle.

Generally, the applicator device comprises a cover cap covering the neck, the dispensing head and the dome, said cover cap comprising a cylindrical side wall obturated at one of its ends by a top. The top of the cover cap may carry, inside the cover cap, a cylindrical sleeve which in the storage position bears on the edge of the outer cylindrical wall of the cap, the cover cap being for example screwed down on a threaded portion on the side of the shoulder remote from the neck. The cover cap may also be secured by interlocking.

Advantageously the bottle is made of a translucent or transparent plastic material and is disposed inside a rigid opaque shell whose bottom comprises an opening allowing the bottom of the bottle to be seen, and the level to which the bottle is filled with the product to become visible.

The bottle may have, at the base of the bellows, a cylindrical portion with a larger diameter extended on the side remote from the bellows by a cylindrical portion of smaller diameter whose base is engaged in a collar surrounding the opening of the bottom of the shell.

This shell has a cylindrical shape towards its end near the dome, and its inner diameter is equal to the outer diameter of the larger diameter portion of the bottle, whilst on the side of said portion remote from the bellows, the shell has an oval cross-section which is internally in contact with the smaller diameter portion of the bottle.

The shell carries means, in particular a thread for fixing the cover cap.

In order that the present invention may more readily be understood two embodiments, represented in the accompanying drawings, will be described below, by way of a purely illustrative and non-restrictive example.

DETAILED DESCRIPTION OF THE INVENTION

Figure 2:
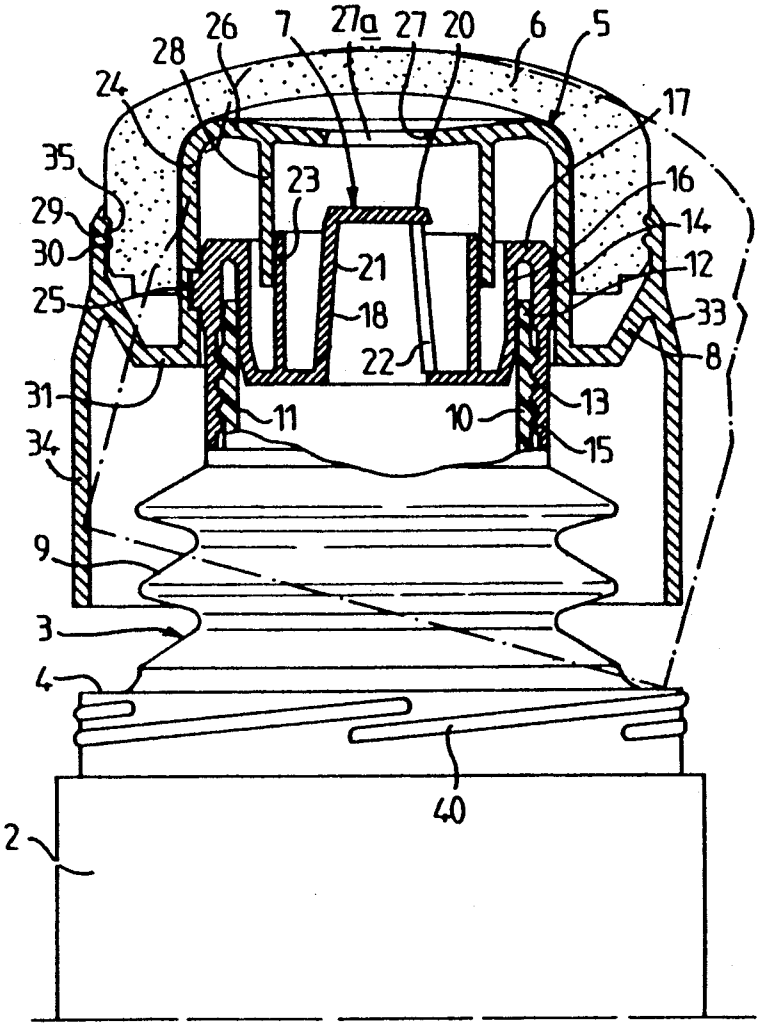
FIG. 2 is a longitudinal sectional view of the device of FIG. 1, shown in the open position.
Figure 1:
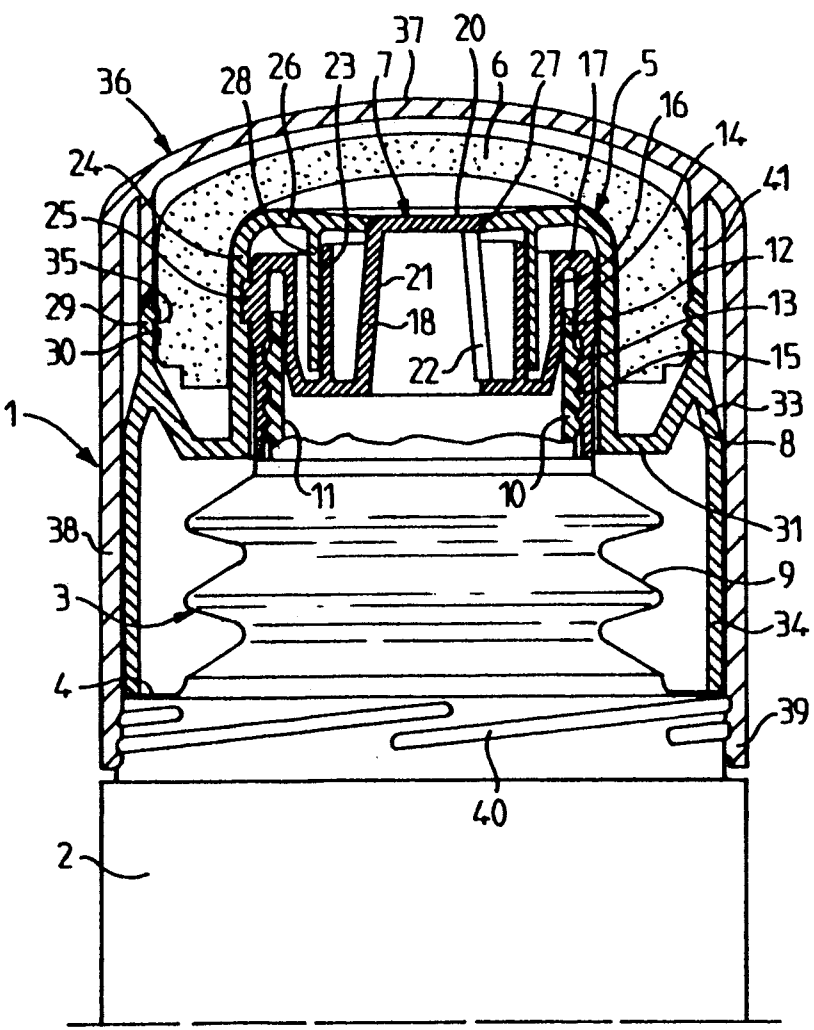
FIG. 1 is a longitudinal sectional view of a first embodiment of an applicator device according to the invention, shown in the closed position.

In FIGS. 1 and 2, it will be seen that the applicator is designated as a whole by the reference numeral 1. It comprises a bottle 2 which is only partly represented. This bottle 2 is provided with a neck 3 and has its body joined to the neck 3 by a shoulder 4. The applicator 1 also comprises a dispensing head 5 formed of three separate parts, namely: (i) a dome 6 made of a rigid porous plastic or ceramic material, (ii) an obturator device 7, and (iii) a cap 8 which supports the dome 6. In the embodiment shown, the neck 3 of the bottle 2 is formed by two zones of which the zone, nearer the bottle 2 is constituted by a flexible bellows 9 with several folds, and the more remote zone of the bottle is a sleeve 10 made of a rigid material. The inner side 11 of the sleeve 10 is smooth, whilst the outer side 12 is provided with a screw thread 13. At the base of its neck 3, the bottle 2 has a shoulder 4 joined to the bottle 2 via a cylindrical bearing surface comprising a screw thread 40, the outer diameter of the bearing surface being slightly smaller than that of the bottle 2. In the storage position of the applicator device, the dome 6 and the cap 8 are covered by a cover cap 36 of a generally cylindrical shape. The top panel 37 of the cover cap 36 is externally convex and surmounts the dome 6; the base of the cover cap 36 comprises an internal screw thread 39 which cooperates with the screw thread 40 to secure the cover cap 36 on the bottle 2. The outer diameter of the cylindrical wall 38 of the cover cap is equal to the outer diameter of the bottle 2 below the shoulder 4.

The cover cap 36 may be translucent so that when it is in position the porous dome 6 is visible.

The obturator 7 comprises three coaxial cylindrical skirts 14, 16, 23 whose bases are circular and whose generatrices are parallel to the axis of the neck 3. The fixing skirt 14 is the outermost one: it comprises on its inner surface a screw thread 15 cooperating with the external screw thread 13 of the rigid portion 10 of the neck 3. The outer side of the sealing skirt 16 comes to bear on the smooth inner side of the rigid sleeve 10 of the neck 3. At their ends nearer the dome 6, the skirts 14 and 16 are interconnected by an annular portion 17. The obturator also comprises a central frusto-conical duct 18 coaxial with the skirts 14 and 16. The smaller diameter base of the cone frustum 18 is closed by a disc 20, and the larger diameter base opens out towards the neck 3. The side wall 21 of the duct 18 is provided with an opening 22. The larger diameter base of the cone frustum is joined to the sealing skirt 16 of the obturator 7 via a flat annular surface perpendicular to the common axis of the skirts 14 and 16. From this annular surface, the cylindrical guidance skirt 23 extends towards the dome 6.

The cap 8 surmounts the obturator 7 and comprises an inner cylindrical wall 24 whose inner surface is in contact with the outer surface of the fixing skirt 14 of the obturator 7. This inner surface, in contact with the outer skirt 14, carries a helical groove cooperating with a stud 25 projecting from the outer surface of the fixing skirt 14 of the obturator 7. The cylindrical wall 24 is closed at one of its ends by a closing element 26 which constitutes a top comprising in its central zone an opening 27*a*; the closing element 26 thus forms an annular surface round the opening 27*a* (FIG. 2) and this surface has a slight convexity towards the obturator 7. The edge 27 of the opening 27*a* is applied to the edge of the disc 20 closing the duct 18 of the obturator 7, when the applicator device 1 is in the closed position shown in FIG. 1. The closing element 26 has a cylindrical skirt 28 extending towards the bottle 2 and coaxial with the opening 27*a*, and this skirt 28 cooperates with slight friction with the guidance skirt 23 of the obturator 7.

The means for supporting the rigid dome 6 of porous material comprise, firstly, the cylindrical wall 24, against which the concave interior of the dome 6 is partly bearing and, secondly, a cylindrical wall 29 of the cap 8. This wall 29 is coaxial with, and disposed around, the wall 24. The space between the inner cylindrical wall 24 and the outer cylindrical wall 29 is such that the free end of the porous dome 6 can be inserted therein, with the dome retained on its supporting means by the catch engagement of an external annular O-ring 35 of the dome 6, in an internal annular groove 30 of the skirt 29. The cylindrical walls 24 and 29 are interconnected at their ends nearer the bottle 2 by an annular surface 31. The cylindrical wall 29 is joined, via a frusto-conical surface 33, to an outer cylindrical support skirt 34. This support skirt 34 has an outer diameter equal to the inner diameter of the cylindrical wall 38 of the cover cap 36 and abuts the shoulder 4 of the bottle 2 when the applicator device is in the closed position. The porous dome 6 comprises a central portion, formed as an outwardly convex spherical cap, joined to a cylindrical portion forming the lateral wall of the dome.

In the closed position shown in FIG. 1, the dispensing head 5 is covered by the cover cap 36. The top panel 37 of the cover cap 36 carries a cylindrical sleeve 41 which, when the applicator device is in the closed position, that is to say when the cover cap 36 is screwed down on the bottle 2, lies in contact with the free end of the cylindrical skirt 29 and is in the extension thereof.

It will be seen from FIG. 1 that when the applicator device is in the closed position the liquid in the bottle 2 cannot reach the porous dome 6, irrespective of the position of the applicator, be it head up, head down or horizontal. Similarly, the liquid vapour cannot penetrate as far as the dome. Indeed, the liquid penetrates through the opening 22 of the duct 18 into a closed space bounded by the two cylindrical guidance skirts 23 and 28 which form a sealing system by means of self-sealing skirts. This space is also closed because the edge 27 of the opening 27*a* of the cap 8 abuts the edge of the disc 20 of-the duct 18 of the obturator 7. The fact that the closing element 26 is also slightly convex on the side facing the obturator 7 allows the edge 27 to exert on the edge of the disc 20 sufficient elastic pressure to ensure sealing.

When the user wishes to use the applicator device, he or she unscrews the cover cap 36 and removes it, so that the dispensing head is then accessible. To dispense the liquid in the bottle 2, the user turns the cap 8 relative to the obturator 7 round the axis of the neck 3, for example by a quarter of a turn. The cap 8 will then have been displaced parallel to the axis of the bottle because of the cooperation of the stud 25 and the helical groove on the inner side of the wall 24. The contact between the edge 27 of the closing element 26 and the disc 20 of the duct 18 no longer exists. Thus there is a progressive opening of the communication between the bottle 2 and the porous dome 6. At the same time, the guidance skirts 28 (of the cap 8) and 23 (of the obturator 7) slide along each other whilst maintaining the seal between them. Similarly, the end of the outer cylindrical support skirt 34 which was in contact with the shoulder 4 moves away from the shoulder, releasing the part of the neck forming the bellows.

FIG. 2 represents the device in accordance with the invention, in its fully open position.

When the user wishes to apply the liquid in the bottle to for example the skin, he turns the applicator upside down in its open position, so as to cause the dome 6 to become impregnated and then effects the application. The part of the neck 3 forming the bellows gives a great softness to the application and allows the dispensing head 5 to be orientated at will. However, the inclination of the dispensing head 5 is limited by the fact that the edge of the skirt 34 of the cap 8 will come into contact with the shoulder 4 of the bottle 2. Thus any risk of damage to the bellows 9 is avoided. In FIG. 2, the maximum inclination of the dispensing head 5 has been shown in chain-dotted lines.

The bellows 9 of the neck 3 allows the rigid dome 6 to follow the parts of the body perfectly. Moreover, the elasticity of the bellows produces, during its dilation, an automatic take-up of the product in the manner of a sponge, even though the dome is rigid.

When the user has stopped using the applicator device, he closes it. Before being able to replace the cover cap 36, he must necessarily start by turning the cap 8 in the opposite direction on the obturator 7; this prevents any incorrect manipulation. The guidance skirts 28 and 23 slide over each other in opposite directions and the lower part of the outer cylindrical guidance skirt 34 comes into contact with the shoulder 4 of the bottle 2. The user then screws down the cover cap 36 on to the shoulder 4, and the sleeve 41 carried by the top panel 37 of the cover cap abuts the skirt 29, so as to form a leak-proof seal. In this way, any liquid which may have remained in the porous dome 6 is prevented from being able to escape from the cover cap during storage; the liquid becomes collected in the free space arranged between the catch-engaged edge of the dome 6 and the cap 8.

Figure 4:
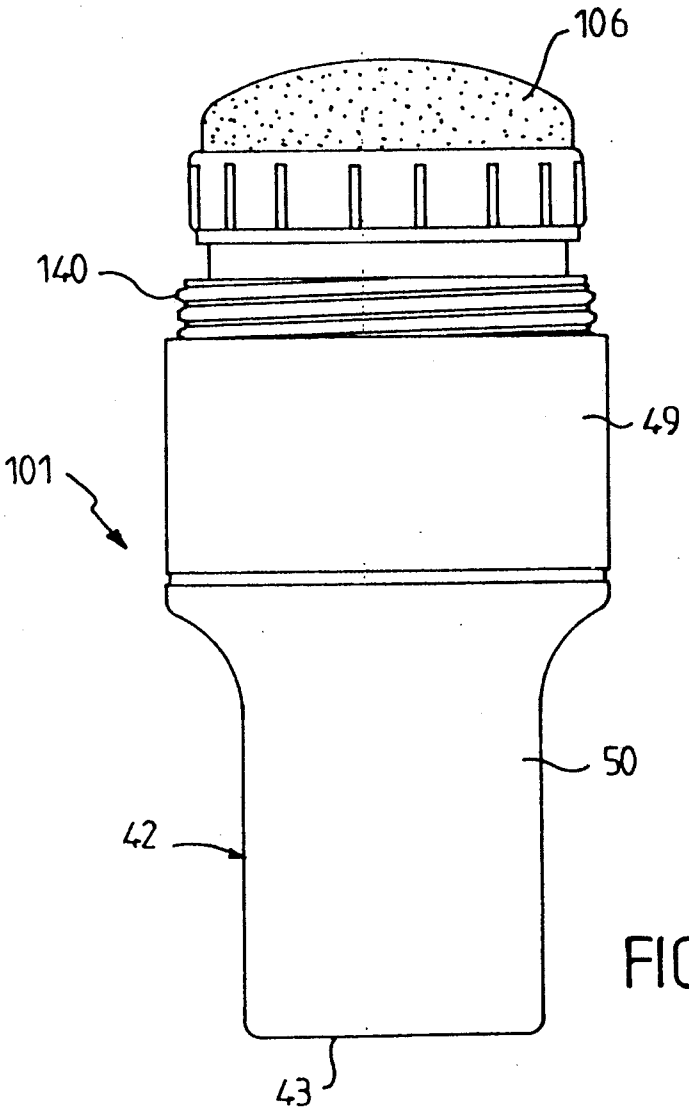
FIG. 4 is a view, looking from the left in relation to FIG. 3, with the applicator device in the open position.
Figure 3:
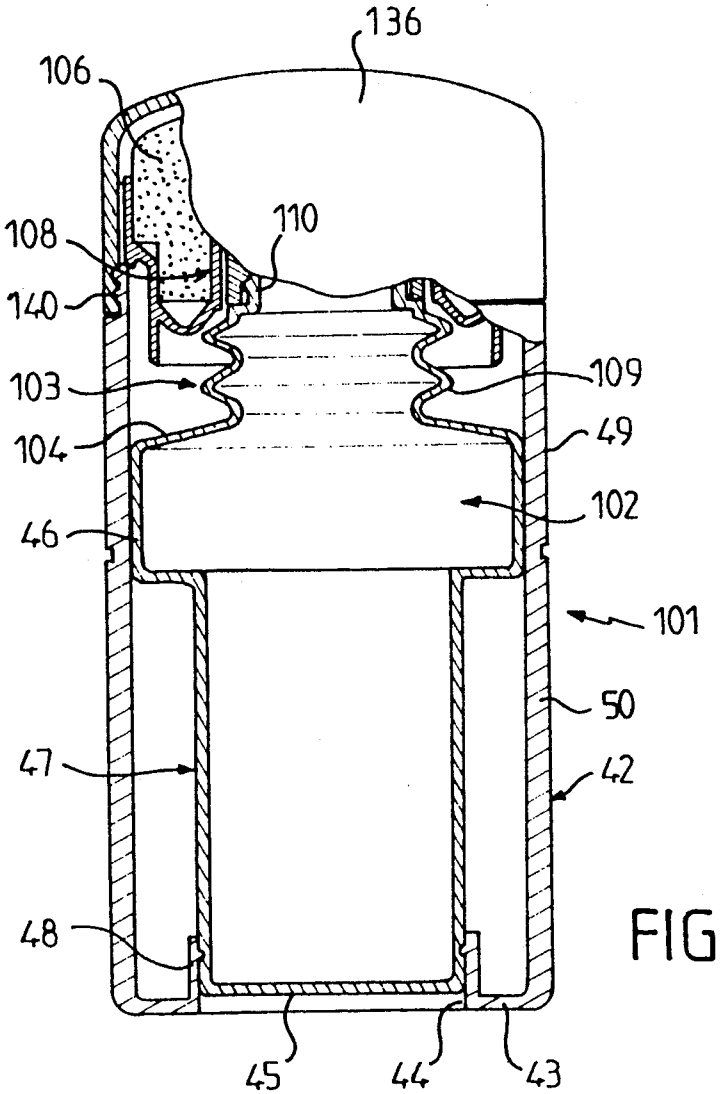
FIG. 3 is a longitudinal sectional view including some external portions, showing another embodiment of the device in the closed position.

FIGS. 3 and 4 show another embodiment of the applicator device in accordance with the invention. Those elements of the device of FIGS. 3 and 4 that are identical with, or perform similar functions to, elements already described with reference to FIGS. 1 and 2 are designated by the same reference numerals increased by 100, and their description will be repeated only in a succinct form, if at all.

The arrangement of the obturator device 107 and of the cap 108 is practically identical with that of FIGS. 1 and 2.

The bottle 102 is made of a translucent or transparent material and is disposed inside an opaque shell 42 whose bottom 43 has an opening 44 allowing the translucent or transparent bottom 45 of the bottle 102 to be seen, and allowing the level to which the bottle is filled with the product to become visible.

Advantageously, the bottle 102 has, at the bottom of the bellows 109, a larger diameter cylindrical portion 46, extended on the side remote from the bellows 109, by a smaller diameter cylindrical portion 47, whose bottom 45 is engaged in a collar 48 surrounding the opening 44.

Towards its end 49 nearer the dome 106, the shell 42 has a cylindrical shape with its inner diameter equal to the outer diameter of the portion 46 of the bottle. On the side of the portion 46 remote from the bellows 109, the shell comprises a portion 50 of oval cross-section whose major axis is equal to the diameter of the portion 46, and whose minor axis is equal to the diameter of the portion 47. The portion 50 has its interior in contact with the portion 47 of the bottle. Holding the device 101 in the vicinity of its portion 50 is facilitated by means of this oval, preferably elliptical, cross-section.

The screw thread 140 intended for fixing the cover cap 136 is provided at the upper end of the cylindrical portion 49 of the shell 42.

The functioning and use of the applicator device of FIGS. 3 and 4 are similar to those described with reference to FIGS. 1 and 2.

I claim:

1. An applicator device for a liquid, comprising: a bottle having a neck comprising at least one flexible zone and on which is fixed a dispensing head carrying a dispensing dome of rigid porous material; wherein the dispensing head comprises on the one hand, an obturator fixed on the neck of the bottle and provided with at least one opening and, on the other hand, a cap comprising means for supporting the dispensing dome; and wherein the cap is mechanically joined to the obturator and is manually actuable in translation parallel to the longitudinal axis of the applicator device between a closed position in which a closing element of the cap cooperates with a stopper element of the obturator to prevent any communication between the inside of the bottle and the dispensing dome, and an open position wherein said communication is obtained, said obturator comprising a circular cylindrical fixing skirt carrying a screw thread which cooperates with a corresponding screw thread on the neck, and said fixing skirt being joined to a stopper element centered on the axis of the neck, said obturator further comprising a cylindrical sealing skirt, which is coaxial with said fixing skirt and annularly joined thereto, and being disposed inside said neck, and being annularly joined to a central duct coaxial with said fixing skirt and said sealing skirt, said duct being open to the inside of the bottle and closed at its other end by said stopper element and said opening being arranged in the lateral wall of said duct.

2. A device according to claim 1, wherein the flexible zone of the neck is constituted by a bellows.

3. A device according to claim 1 or 2, wherein the dispensing dome is made of a plastic or ceramic which is rigid and porous.

4. A device according to claim 1, wherein the obturator comprises a guidance skirt coaxial with the fixing skirt and carried by the annular connection between the sealing skirt and the side wall of the duct on the side of said connection facing the dispensing dome, said guide skirt cooperating with slight friction with an associated skirt carried by the element for closing the cap.

5. A device according to claim 1, wherein in the cap the means for supporting the dispensing dome are constituted by inner and outer coaxial cylindrical walls interconnected at their edges situated nearer the bottle, said walls forming between them a space having a radial dimension such that the edge of the dispensing dome can be inserted therein, and said inner wall being adjacent the fixing skirt of the obturator.

6. An applicator device for a liquid, comprising: a bottle having a neck comprising at least one flexible zone and on which is fixed a dispensing had carrying a dispensing dome of rigid porous material; wherein the dispensing head comprises on the one hand, an obturator fixed on the neck of the bottle and provided with at least one opening and, on the other hand, a cap comprising means for supporting the dispensing dome; and wherein the cap is mechanically joined to the obturator and is manually actuable in translation parallel to the longitudinal axis of the applicator device between a closed position in which a closing element of the cap cooperates with a stopper element of the obturator to prevent any communication between the inside of the bottle and the dispensing dome, and an open position wherein said communication is obtained, wherein, in the cap, the means for supporting the dispensing dome are constituted by inner and outer coaxial cylindrical walls interconnected at their edges situated nearer the bottle, said walls forming between them a space having a radial dimension such that the edge of the dispensing dome can be inserted therein, and said inner wall being adjacent the fixing skirt of the obturator, said inner cylindrical wall having on its inner side a helical groove cooperating with an outwardly projecting stud of said fixing skirt of the obturator so as to render the cap movable in translation relative to the obturator when the cap is rotated relative to the bottle, the stopper element being a flat disc which is capable of being accommodated in an opening in the central zone of said closing element.

7. A device according to claim 6, wherein said inner cylindrical wall of the cap comprises at its end situated nearer the dispensing dome, a closing element forming a top which forms together with said outer cylindrical wall an angle equal to or slightly less than 90° so that, when the dispensing head is in said closed position, the closing element bears with the edge of its opening on the edge of said flat disc so as to form a leakproof seal closing the duct of the obturator whereas when the dispensing head is in said open position, the closing element is disposed in the space comprised between the flat disc and the dispensing dome.

8. A device according to claim 5, 6 or 7, wherein said inner cylindrical wall of the cap is extended towards the bottle by a cylindrical support skirt having an external diameter close in magnitude to that of the bottle at the base of the neck and having a length such that in the closed position of the dispensing head said cylindrical support bears on a shoulder situated at the base of the neck of the bottle.

9. A device according to claims 1 or 8, and further comprising a cover a cover cap covering the neck, the dispensing head, and the dome; and wherein said cover cap comprises a cylindrical side wall obturated at one of its ends by a top panel.

10. A device according to claim 9, wherein the top panel of the cover cap carries inside the cover cap a cylindrical sleeve which, in the storage position, bears on the edge of said outer cylindrical wall of the cap; and wherein the cover cap is screwed down on a threaded portion provided on the side of the shoulder remote from the neck.

11. A device according to claims 1 or 9, wherein the bottle is made of a translucent or transparent material and is disposed inside a rigid opaque shell whose base comprises an opening allowing the base of the bottle to be seen and allowing the level to which the bottle is filled with the product to become visible.

12. A device according to claim 11, wherein the bottle has at the base of the bellows a large diameter cylindrical portion extended on the side remote from the bellows by a smaller diameter cylindrical portion whose bottom is engaged in a collar surrounding said opening of the base of the shell.

13. A device according to claim 12, wherein the shell has towards its end nearer the dome a cylindrical shape, and wherein the inner diameter of the shell is equal to the outer diameter of the large diameter portion of the bottle, whereas on that side of said larger diameter portion which is remote from the bellows the shell has an oval cross-section portion which is internally in contact with the smaller diameter portion of the bottle.

14. An applicator device for a liquid, comprising: a bottle having a neck comprising at least one flexible zone and on which is fixed a dispensing head carrying a dispensing dome of rigid porous material; wherein the dispensing head comprises on the one hand, an obturator fixed on the neck of the bottle and provided with at least one opening and, on the other hand, a cap comprising means for supporting the dispensing dome; and wherein the cap is mechanically joined to the obturator and is manually actuable in translation parallel to the longitudinal axis of the applicator device between a closed position in which a closing element of the cap cooperates with a stopper element of the obturator to prevent any communication between the inside of the bottle and the dispensing dome, and an open position wherein said communication is obtained, said obturator comprising a circular cylindrical fixing skirt carrying a screw thread which cooperates with a corresponding screw thread on the neck, and said fixing skirt being joined to a stopper element centered on the axis of the neck, said obturator comprising a guidance skirt coaxial with the fixing skirt and carried by the annular connection between the sealing skirt and the side wall of the duct on the side of said connection facing the dispensing dome, said guidance skirt cooperating with slight friction with an associated skirt carried by the element for closing the cap.

15. A device according to claim 14, wherein, in the cap, the means for supporting the dispensing dome are constituted by inner and outer coaxial cylindrical walls interconnected at their edges situated nearer the bottle, said walls forming between them a space having a radial dimension such that the edge of the dispensing dome can be inserted therein, and said inner wall being adjacent the fixing skirt of the obturator.

* * * * *